US005284030A

United States Patent [19]

Schmid et al.

[11] Patent Number: 5,284,030

[45] Date of Patent: Feb. 8, 1994

[54] FLAT KNITTING MACHINE STOP MOTION ASSEMBLY

[75] Inventors: Franz Schmid, Bodelshausen; Jurgen Ploppa, Pfullingen; Heinz Wilhelm, Mossingen, all of Fed. Rep. of Germany

[73] Assignee: H. Stoll GmbH & Co., Fed. Rep. of Germany

[21] Appl. No.: 945,321

[22] Filed: Sep. 17, 1992

[30] Foreign Application Priority Data

Sep. 17, 1991 [DE] Fed. Rep. of Germany ..... 4130816

[51] Int. Cl.[5] ..... D04B 7/00

[52] U.S. Cl. ..... 66/60 R; 66/157; 66/64

[58] Field of Search ..... 66/60 R, 157; 19/0.2; 335/140, 160, 177, 179; 139/368, 370.1, 370.2; 112/271

[56] References Cited

U.S. PATENT DOCUMENTS 3,369,205 2/1968 Hamrick ..... 335/177
4,237,439 12/1980 Nemoto ..... 335/179 X
4,454,631 6/1984 Schwartz ..... 19/0.2
4,821,534 4/1989 Goller et al. ..... 66/60 R

FOREIGN PATENT DOCUMENTS 0192759 11/1984 Japan ..... 66/60 R
2085057 4/1987 Japan ..... 66/60 R
2085058 4/1987 Japan ..... 66/157
2206068 9/1987 Japan ..... 66/60 R

*Primary Examiner*—Clifford D. Crowder
*Assistant Examiner*—John J. Calvert
*Attorney, Agent, or Firm*—Larson and Taylor

[57] ABSTRACT

In a flat knitting machine equipped with a manually movable handlebar (11) which is oriented parallel to a needle bed, the eccentrically mounted handlebar (11) is connected to a pivoting lever (15) which is the carrier of an armature (19) for a stationarily arranged electromagnet which can be excited via a control device and which, in the excited state, keeps the handlebar in an end position. The arrangement is such that, when the handlebar (11) is struck from above, the magnetic coupling can be released and it is also thereby possible to switch off the machine drive by hand in the quickest way possible.

5 Claims, 3 Drawing Sheets

FLAT KNITTING MACHINE STOP MOTION ASSEMBLY

BACKGROUND OF THE INVENTION

The invention relates to a flat knitting machine having a device serving for switching on, accelerating and switching off the carriage drive and possessing a manually movable handlebar which is oriented parallel to a needle bed and which is mounted eccentrically at its ends and can be pivoted between a lower and an upper end position and fixed at least in the upper end position.

Flat knitting machines with handlebars of the type mentioned are known, for example from German Offenlegungsschrift 3,705,125 of the Applicant. In addition to the problem of a sensitive control of the carriage drive by such a handlebar, there is the requirement of a rapid cut-off of the carriage drive also by hand. The last-mentioned requirement is not satisfied to a sufficient extent in the hitherto known handlebars, because the mechanical end-position interlocks used act with a time delay. The object on which the invention is based is, therefore, to design a flat knitting machine of the type mentioned in the introduction, in such a way that the carriage drive can also be cut off abruptly by means of the handlebar.

SUMMARY OF THE INVENTION

The set object is achieved, according to the invention, in that the handlebar is fixed in its upper end position by means of a stationarily arranged electromagnet which can be excited via an electrical control device of the flat knitting machine and which interacts with an armature located at the end of a pivoting arm coaxial with the pivot axis of the handlebar and coupled rigidly to the handlebar.

The magnetic retention of the handlebar in its upper end position can be released simply by striking the handlebar. There is no need for a more complicated rotation of the handlebar in order to release an interlock and cut off the carriage drive. On the one hand, the electromagnet excited by the control device of the flat knitting machine ensures that the handlebar is retained only when specific conditions for a safe operation of the machine are satisfied. On the other hand, the control device can be so designed that, in the event of a positive release of the armature from the electromagnet as a result of a strike against the handlebar, an immediate cut-off of the carriage drive can be triggered, even before the handlebar has reached its lower end position if appropriate sensors are used.

Advantageously, the electromagnet can be arranged at least approximately level with the pivot axis of the handlebar and so that, in the bearing position, the longitudinal axis of the handlebar is located between electromagnet and pivot axis. With this arrangement, the device is as sensitive as it can be to a strike against the handlebar from above, such as can be executed in the simplest and quickest way by an attendant from his tending position. The eccentric axis of rotation for the handlebar can extend within the cross-sectional range of the handlebar, so that the pivoting travel of the handlebar between its end positions remains small.

The pivoting arm carrying the armature for the electromagnet can additionally be equipped with a toothed quadrant which, in a way already proposed, is in engagement with a toothed pinion which is fastened on a control shaft of the device for switching the carriage drive and which causes a control of the carriage drive in dependence on the pivoting position of the handlebar.

BRIEF DESCRIPTION OF THE DRAWINGS

An exemplary embodiment of a flat knitting machine designed according to the invention is explained in more detail below by means of the accompanying drawing which shows only one of the bearing points of the handlebar together with the parts essential to the invention.

In the drawing, in particular.

DETAILED DESCRIPTION OF THE PREFERRED EMBODIMENT

Figure 1:
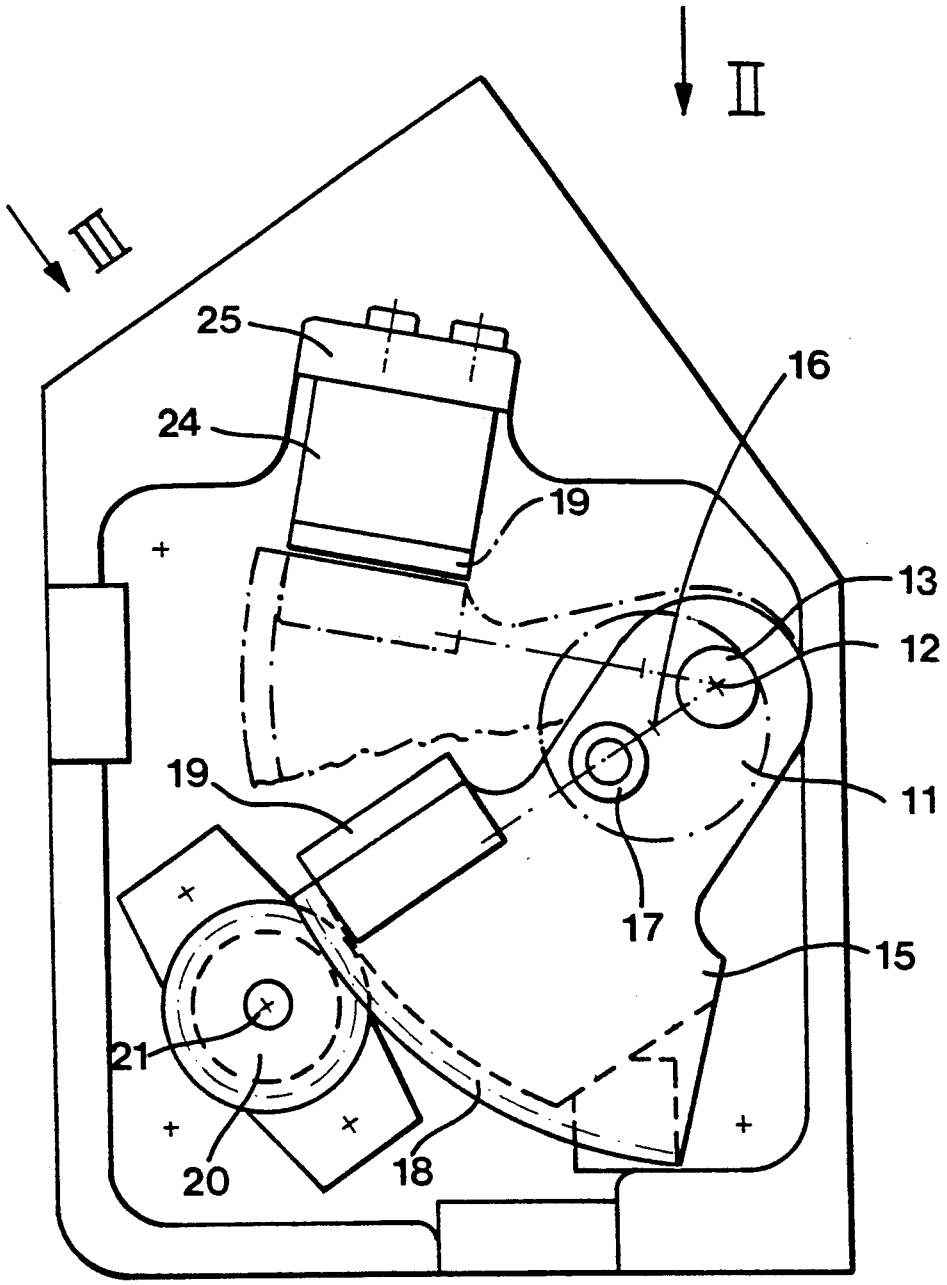
FIG. 1 shows a side view of the bearing point in the axial direction of the handlebar.
Figure 2:
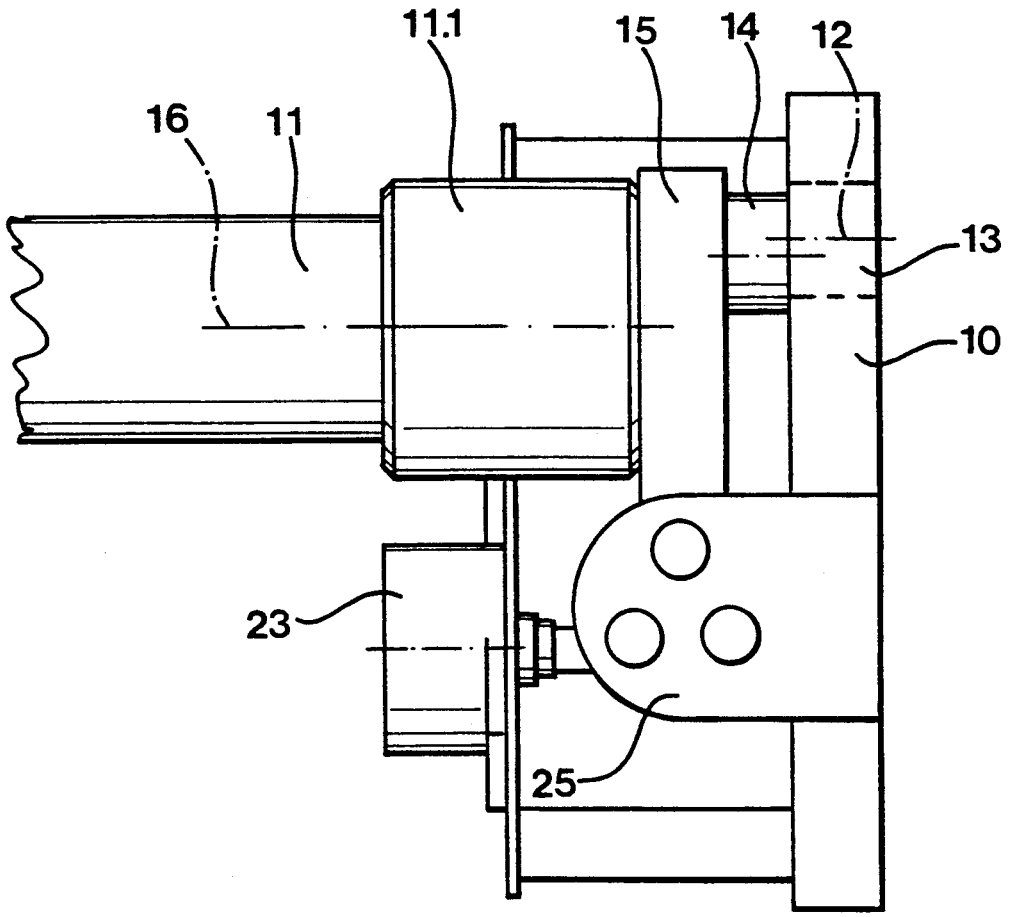
FIG. 2 shows a top view of the bearing point in the direction of the arrow II in FIG. 1.
Figure 3:
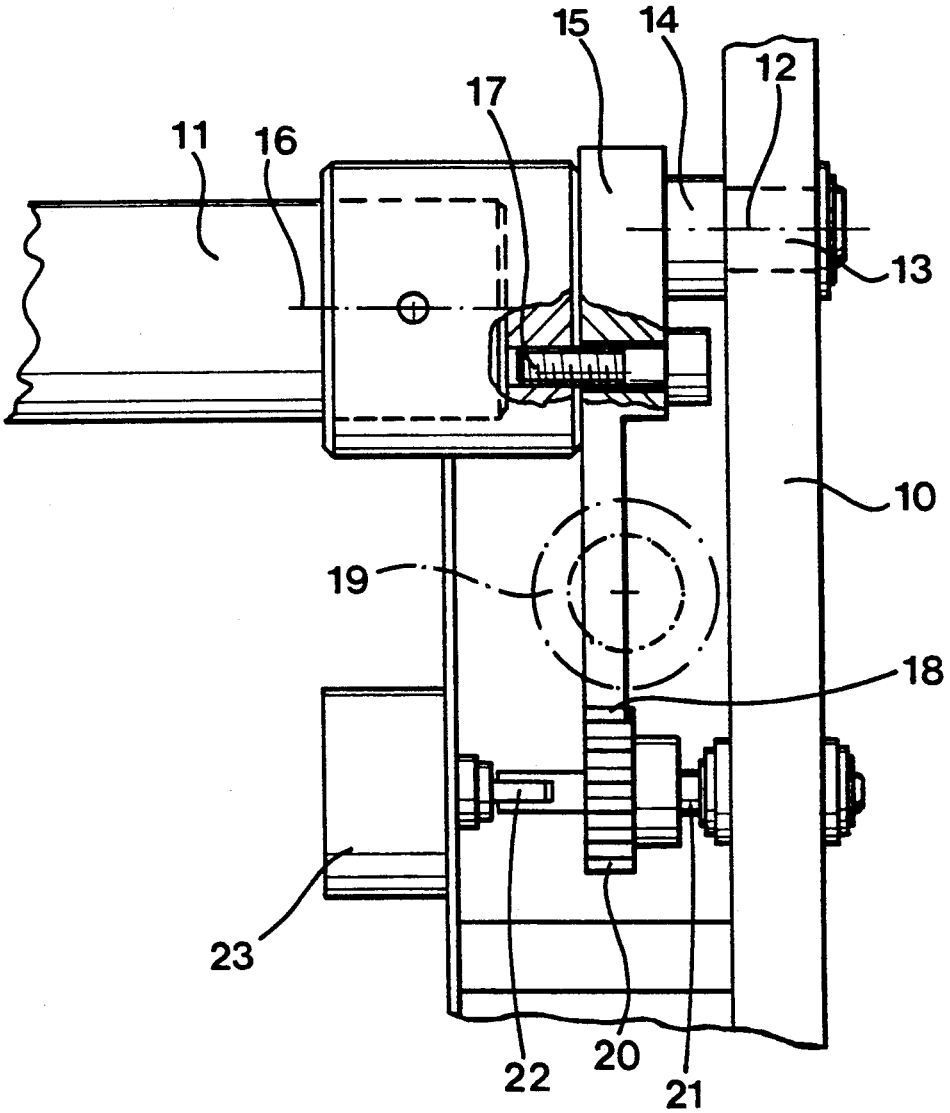
FIG. 3 shows a view of the bearing point from above in the direction of the arrow III in FIG. 1, with the handlebar in its lower initial position.

FIGS. 1–3 illustrate that in the flat knitting machine of the invention only a wall part 10, in which a handlebar 11 extending in a known way parallel to a needle bed (not shown) is mounted indirectly. The pivot axis 12 of the handlebar 11 is defined by a bolt 13 which is mounted in the wall 10 and which is connected to a pivoting lever 15 via an eccentric connection piece 14. An end portion 11.1 of the handlebar 11 bears on its end face against a side face of the pivoting lever 15, in such a way that the pivot axis 12 is offset relative to the longitudinal axis 16 of the handlebar 11, but still extends within the cross-sectional range of the handlebar 11. The end portion 11.1 of the handlebar 11 is fastened to the pivoting lever 15 by means of a fastening screw 17 evident from FIG. 3.

The pivoting lever 15 has at its free end a toothed quadrant 18 and carries on one side a disc-shaped armature 19 made of soft iron. The toothed quadrant 18 interacts with a toothed pinion 20 fastened on a shaft 21 which is mounted in the wall 10 and which, according to FIG. 3, is drive-connected to the shaft of the stationarily arranged potentiometer 23 via a coupling 22. The disc-shaped armature 19 interacts with a pot magnet 24, evident from FIG. 1, which has an exciting winding (not shown) and which is screwed to a web 25 projecting from the wall 10.

The potentiometer 23 and the pot magnet 24 are parts of a control device of the flat knitting machine. The rotational speed of the drive (not shown) for the carriage of the flat knitting machine is influenced in a known way via the potentiometer 23. In the excited state, the pot magnet 24 causes the pivoting lever to be retained in its upper pivoting position represented in FIG. 1 by dot-and-dash lines. The pot magnet 24 can additionally be coupled to sensors recording the bearing contact of the armature 19. The handlebar can be under the load of a spring which prestresses it into an initial position, in which the pivoting lever 15 assumes the position represented by unbroken lines in FIG. 1.

The pivoting lever 15 is moved upwards as a result of the rotation of the handlebar 11 in the clockwise direction about its eccentric bearing axis 12. The adjustment of the potentiometer 23 taking place via the gearwheel 20 causes an acceleration of the carriage drive. If the control device of the flat knitting machine does not record any fault, the pot magnet 24 is excited and retains the pivoting lever 15 and therefore the handlebar 11 in its upper end position at the full carriage-drive speed. Simply by striking the handlebar 11 from above, that is to say in the direction of the arrow II in FIG. 1, the magnetic retention of the handlebar can be interrupted in the quickest possible way and consequently also the carriage drive switched off in the shortest possible time.

We claim:

1. A device for switching on, accelerating and switching off a carriage drive of a flat knitting machine comprising:

a manually movable handlebar oriented parallel to a needle bed of said flat knitting machine;

a potentiometer for controlling speed of said carriage device;

means, in communication with said potentiometer, for pivoting said handlebar between a lower end position and an upper end position;

means for mounting said pivoting means to a wall of said flat knitting machine such that a pivot axis of said handlebar is offset from a longitudinal axis of said handlebar;

a stationarily positioned electromagnet; and an armature located at an end of said pivoting means, wherein when said electromagnet is excited, said armature remains in contact with said electromagnet, retaining said handlebar in said upper end position, and, when said handlebar is struck, said handlebar is no longer retained in said upper end position and said pivoting means pivots into said lower end position, setting said potentiometer to zero, thus switching off said carriage drive.

2. A device according to claim 1, wherein said electromagnet is arranged with its bearing region, where said electromagnet contacts said armature in a bearing position, at least approximately level with said pivot axis of the said handlebar and so that, in said bearing position, said longitudinal axis of said handlebar is located between said armature, capable of bearing on the electromagnet, and said pivot axis.

3. A device according to claim 1, wherein said pivot axis for of said handlebar extends within a cross-sectional range of said handlebar.

4. A device according to claim 1 further comprising:

a control shaft mounted in said wall;

a gearwheel attached to said control shaft and to said potentiometer; and a toothed quadrant, on a free end of said pivoting means, engaged with said gearwheel.

5. A method of quickly stopping a carriage drive in a flat knitting machine, comprising the steps of:

retaining a lever attached to a handlebar in an upper end position using an electromagnet;

striking said handlebar;

interrupting said retaining by said electromagnet in response to said striking;

pivoting said lever to a lower end position about an axis eccentric to a longitudinal axis of said handlebar; and stopping said carriage drive in response to said pivoting.

* * * * *